United States Patent [19]

Kakehi et al.

[11] 4,382,413

[45] May 10, 1983

[54] EARTHQUAKE RESISTANT CRANE

[75] Inventors: Yutaka Kakehi; Katsuyuki Terada; Kenjiro Kasai; Keiichiro Torii; Toru Saito, all of Kudamatsu, Japan

[73] Assignee: Hitachi, Ltd., Tokyo, Japan

[21] Appl. No.: 120,847

[22] Filed: Feb. 12, 1980

[30] Foreign Application Priority Data

Feb. 20, 1979 [JP] Japan ..... 54-17841

[51] Int. Cl.[3] ..... B61F 5/30; B61D 15/00

[52] U.S. Cl. ..... 105/163 R; 105/209; 105/218 A; 188/378; 212/146; 280/701

[58] Field of Search ..... 105/163 R, 163 S, 163 K, 105/180, 182 R, 194, 199 R, 209, 218 A; 280/701, 708, 724, 725; 188/378-380; 212/146

[56] References Cited

U.S. PATENT DOCUMENTS

| | | | |
|---|---|---|---|
| 1,328,934 | 1/1920 | Valls | 105/163 R |
| 1,959,548 | 5/1934 | Ries | 280/724 X |
| 2,430,248 | 11/1947 | Powarzynski | 280/725 |
| 2,887,310 | 5/1959 | Muller | 280/725 X |
| 2,957,432 | 10/1960 | Schurel | 105/163 R |
| 3,257,968 | 6/1966 | Minty et al. | 105/163 R |
| 3,334,596 | 8/1967 | Suri | 105/180 |
| 3,387,857 | 6/1968 | Roberts | 280/725 X |
| 3,674,285 | 7/1972 | Grosseau | 280/724 |
| 4,161,144 | 7/1979 | Raugulis et al. | 105/163 R |

FOREIGN PATENT DOCUMENTS

| | | | |
|---|---|---|---|
| 1483928 | 5/1967 | France | 280/708 |
| 573265 | 11/1945 | United Kingdom | 105/180 |

*Primary Examiner*—Randolph Reese

*Attorney, Agent, or Firm*—Antonelli, Terry & Wands

[57] ABSTRACT

An earthquake-resistant crane including a plurality of girders supported on wheels for movement along rails includes a vertical vibration damping device to ensure safe operation of the crane. The vertical vibration damping device includes a resilient support for supporting the girders in a vertical direction, a vibration direction converting arrangement mounted between the girders and the wheels for converting vertical vibrations of the girders to a horizontal displacement of the wheels, and drive control device connected to the wheels. The vertical vibration damping device operates such that the vertical vibrations of the girders are converted to a horizontal displacement of the wheels to dissipate the energy of vibrations by the sliding friction produced between the wheels and the rails when the wheels move in the horizontal direction, whereby the amplitude of vibrations produced in response to the vertical vibrations of the girders can be reduced.

5 Claims, 21 Drawing Figures

EARTHQUAKE RESISTANT CRANE

BACKGROUND OF THE INVENTION (1) Field of the Invention

This invention relates to a crane provided with means for damping vertical vibrations for the safety of the crane, and more particularly to an overhead travelling crane provided with means for coping with vertical earth tremors of high intensity in the event of an earthquake.

(2) Description of the Prior Art

An overhead travelling crane of the prior art will be described by referring to FIGS. 1 and 2 showing the crane in its entirety and FIGS. 3 and 4 showing its travelling device in a fragmentary view.

As shown in FIGS. 1 and 2, an overhead travelling crane of the prior art comprises two parallel girders 1, connecting girders 12 each connecting the girders 1 together at opposite ends thereof, a travelling device 14 disposed on the undersurface of the opposite ends of the girders 1 for movement on rails 8*a* each supported on one of a plurality of saddles 38 formed on a shed 8, a pair of transverse rails 13B supported on the girders 1, and a trolley 13 provided with wheels 13A for movement on the rails 13B. As shown in FIGS. 3 and 4, the travelling device 14 comprises a pair of saddles 2 formed on the undersurface of each of opposite end portions of each girder 1, a pair of trucks 4 pivotally supported through a truck pin 3 by the pair of saddles 2, and a plurality of pairs of wheels 7 each pair being rotatably connected to one of the trucks 4 forming the pair in such a manner that the wheels 7 forming a pair are mounted at the front end and the rear end respectively of each truck 4 through a bearing 9 and an axle 10, so that the wheels 7 run on the rails 8A.

In the overhead crane of the prior art constructed as aforesaid, all the elements from the wheels 7 to the girders 1 are rigidly connected together, so that it is only the structural damping of the girders 1 that can be expected to have effects on vertical vibrations. Thus, the damping ratio of the crane is only 1-2%. Consequently, if the number of vibrations of high spectral density coincides with the natural frequency of vertical bending vibrations of the girders 1 in the event of an earthquake, the crane will be vigorously vibrated in response with the exciting force of the earthquake, thereby resulting in rupture of the girders 1 or breakage of wires when a load is supported by the girders.

In order to avoid resonance of the girders in the event of an earthquake, it is necessary to reduce the bending stress of the girders by increasing the natural frequency of the vertical bending vibrations of the girders with the notion that the frequency components of the earthquake are wide in range. However, if this requirement is met, it will be inevitable that the crane is increased in weight and the construction is uneconomical.

SUMMARY OF THE INVENTION

This invention has as its object the provision of a crane wherein, when an exciting force is applied to its girders, the girders produce vibrations of a small amplitude relative to the amplitude of the exciting force applied thereto or the girders have a relatively low response ratio, whereby the crane can economically cope with vertical vibrations, such as vertical earth tremors which are produced in the event of an earthquake.

According to the invention, the travelling device of the crane is provided with vibration direction converting means for converting vertical vibrations to horizontal vibrations so as to set in motion the damping function of the sliding friction produced between the wheels and rails, so that the response of the girders to vertical bending vibrations can be greatly reduced. Thus, the crane is highly resistant to critical vibrations, particularly strong vertical earth tremors produced as in the event of an earthquake, and its safety is assured.

DETAILED DESCRIPTION OF THE PREFERRED EMBODIMENTS

Figure 1:
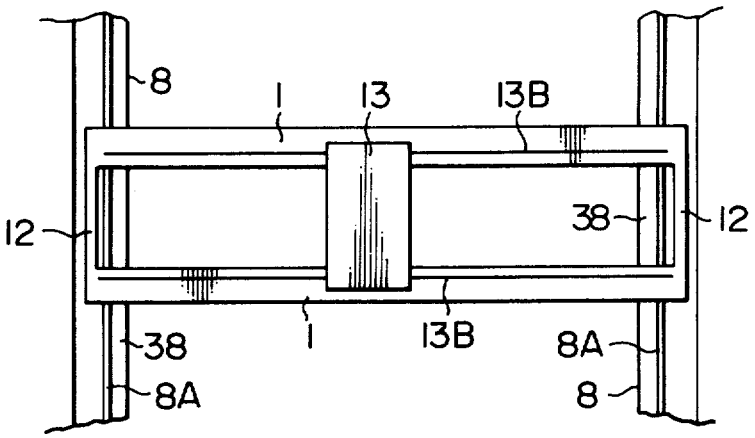
FIG. 1 PRIOR ART
FIG. 1 is a top plan view of an overhead crane of the prior art as mounted in a shed.
Figure 2:
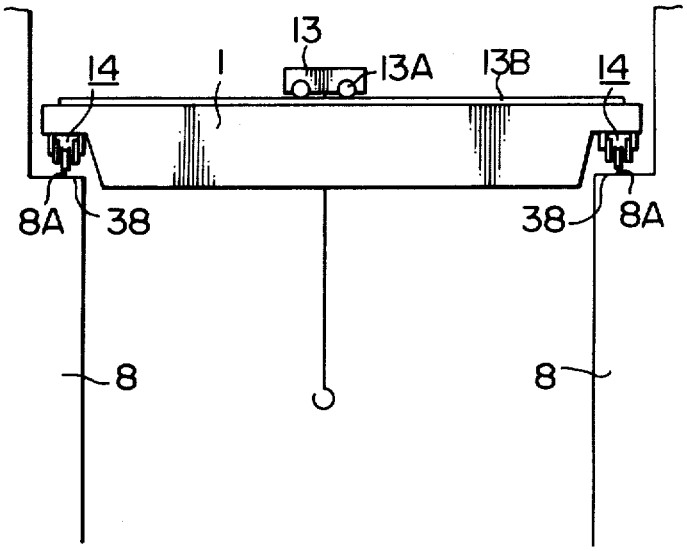
FIG. 2 PRIOR ART
FIG. 2 is a front view of the overhead crane of the prior art shown in FIG. 1.
Figure 3:
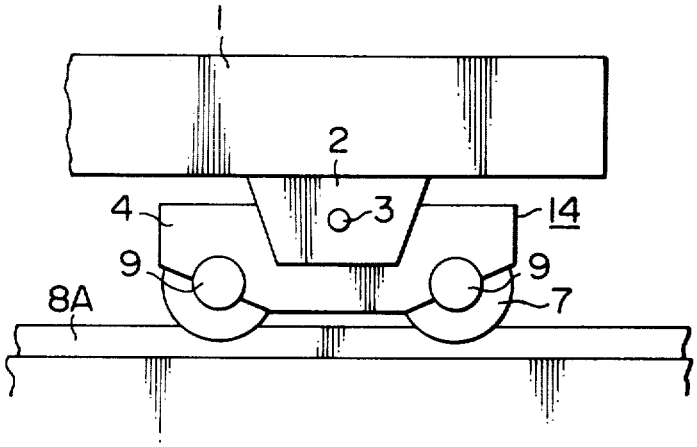
FIG. 3 PRIOR ART
FIG. 3 is a side view of the travelling device of the overhead crane of the prior art shown in FIGS. 1 and 2.
Figure 4:
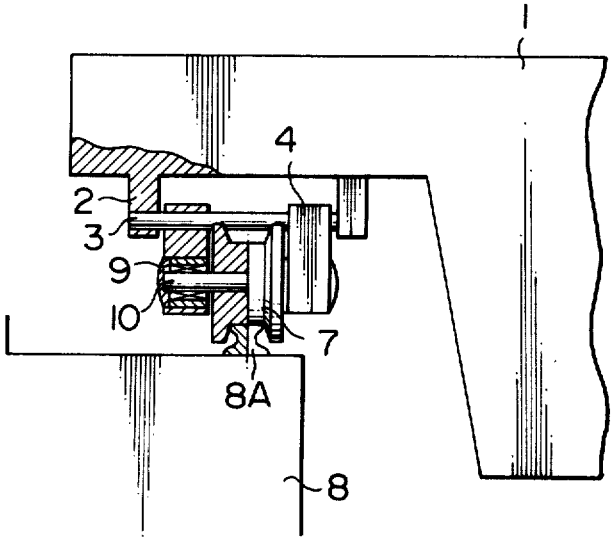
FIG. 4 PRIOR ART
FIG. 4 is a fragmentary front view, with certain parts being shown in section, of the travelling device of the prior art shown in FIGS. 1-3.
Figure 5:
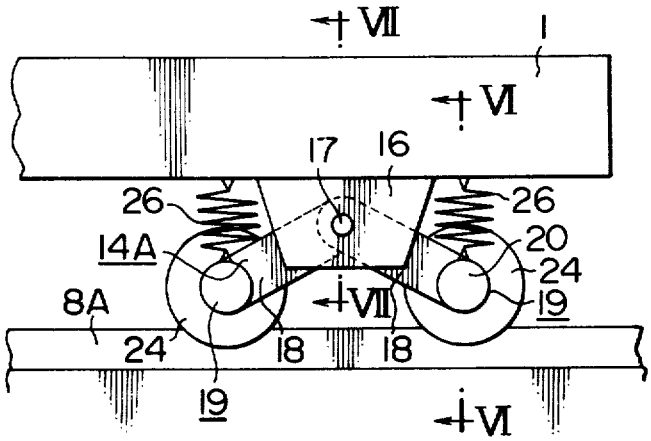
FIG. 5 is a side view of a first embodiment of the overhead crane in conformity with the present invention, showing particularly its travelling device.
Figure 6:
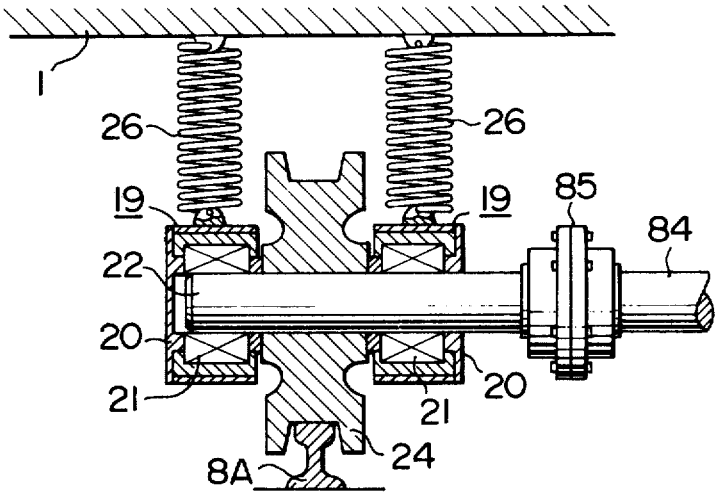
FIG. 6 is a sectional view of the travelling device of the first embodiment taken along the line VI—VI in FIG. 5.
Figure 7:
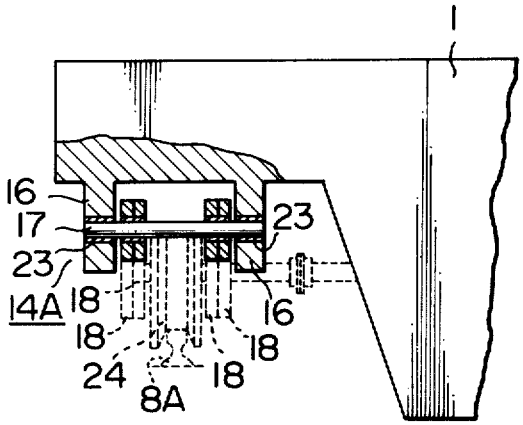
FIG. 7 is a sectional view of the travelling device of the first embodiment taken along the line VII—VII in FIG. 5.

All the embodiments of the invention from the first embodiment to the fifth embodiment have application in an overhead travelling crane. FIGS. 5–11 show a first embodiment wherein girders 1 of an overhead travelling crane each have a pair of saddles 16 formed on the undersurface of each of opposite ends of each girder 1, with the saddles 16 depending from the undersurface in spaced parallel relation. Extending through the pair of saddles 16 through bushes 23 is a crank pin 17 which pivotally supports two pairs of cranks 18. Each pair of cranks 18 is connected to one of opposite ends of the crank pin 17 with the cranks 18 of each pair directed downwardly and inclined in opposite directions or forwardly and rearwardly with respect to the length of each saddle 16. As shown in FIG. 6, each crank 18 has secured to its lower end a bearing box 19 including a cover 20 and a bearing 21. An axle 22 for wheels 24 supported on the rails 8A extends through the juxtaposed bearing boxes 19 for moving the overhead travelling crane. The girder 1 has a compression spring 26 mounted between it and each of the bearing boxes 19 to function as resilient means.

Figure 10:
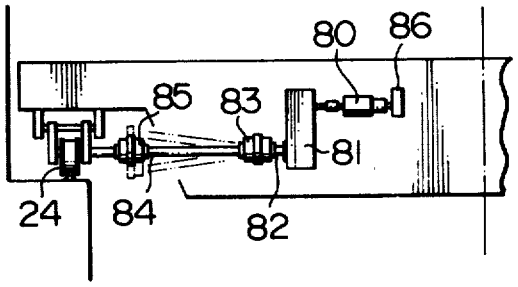
FIG. 10 is a schematic front view of the drive control means for the travelling device of the overhead crane according to the invention.
Figure 11:
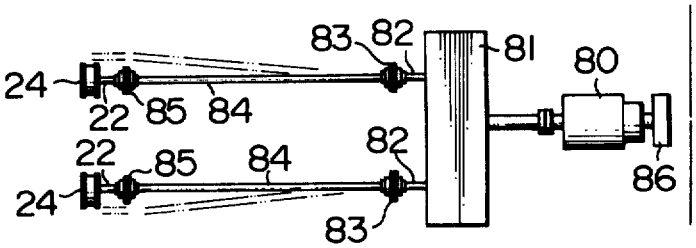
FIG. 11 is a schematic plan view of the drive control means shown in FIG. 10.

The overhead travelling crane comprises drive control means for controlling the movement of the crane by driving the wheels 24 or stopping the rotation thereof so as to cause the crane to travel as desired. The drive control means is shown in FIGS. 10 and 11. As shown, the drive control means comprises a motor 80 mounted on each girder 1 of the overhead travelling crane including an output shaft connected at one end to a speed reducing gearing 81, a drive portion including two output shaft 82 of the gearing 81 each connected through a flexible gear coupling 83 to one end of each of two intermediate shafts 84 connected at the other end thereof to one of the axles 22 for the wheels 24 through another flexible gear coupling 85, and a brake portion including a brake 86 connected to the other end of the output shaft of the motor 80. The drive control means for the travelling device constructed as aforesaid is mounted at each of the opposite end of each girder 1 of the crane. When the crane is driven for movement, the brake 86 is released and the motive force of the motor 80 is transmitted successively through the speed reducing gearing 81, intermediate shafts 84 and axles 22 to the wheels 24 to rotate same. When it is desired to stop the movement of the crane, the brake 86 is actuated to apply the brake to the output shaft of the motor 80 so that the braking force is successively transmitted through the speed reducing gearing 81, intermediate shafts 84 and axles 22 to the wheels 24 to stop rotation of same. When the wheels 24 are displaced either vertically or horizontally with respect to the girder 1, the intermediate shafts 84 can move into a tilting position both vertically and horizontally by the action of the flexible gear couplings 84 and 85 as shown in FIGS. 10 and 11, so that no unduly high forces are applied to the output shaft 82 of the gearing 81 and the axles 22.

Figure 8:
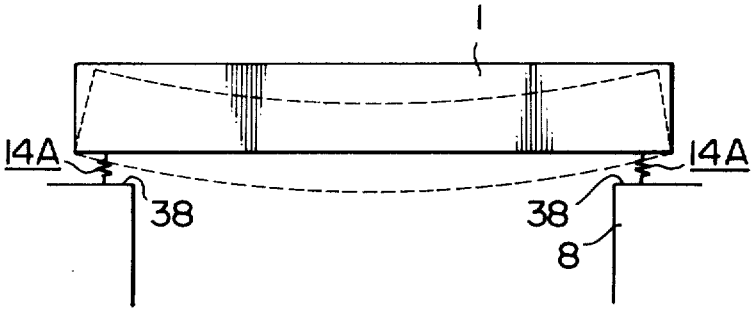
FIG. 8 is a view in explanation of the principle of operation of the first embodiment.
Figure 9:
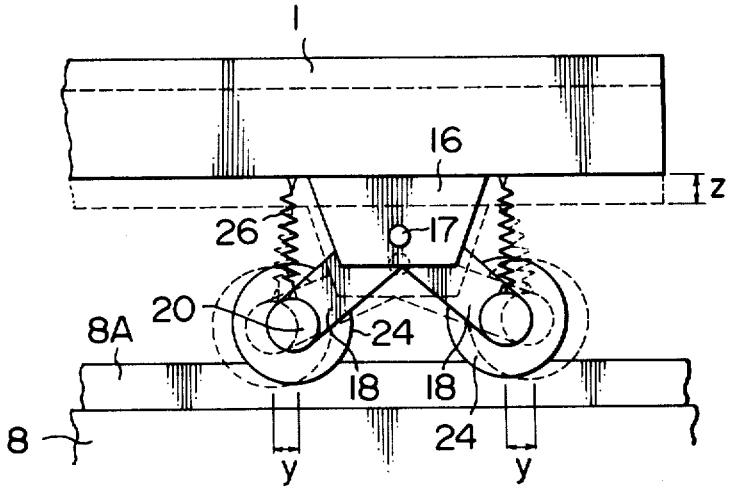
FIG. 9 is a view in explanation of the operation of the travelling device of the first embodiment.

A travelling device 14, connected to the drive control means of the aforesaid construction, operates such that the compression springs 26 bear a part of the mass of the girder 1 while the cranks 18 and saddles 16 bear the rest of the mass of the girder 1. The overhead travelling crane of the aforesaid construction can be grasped in principle as an entity in which, as shown in FIG. 8, the girder 1 is supported at either end thereof by the travelling device 14A which functions as resilient means having a vibration damping function. That is, the travelling device 14A performs the function of damping vibrations by operating as shown in FIG. 9 when the girder 1 moves in vertical vibrations. More specifically, when a vertically directed force is applied to the shed 8 to subject same to vibration, vibrations of the shed 8 are transmitted through the rails 8A and wheels 24 to the girder 1 by way of either the resilient means 26 or the cranks 18 and saddles 16. In this case, the girder 1 moves in vertical bending vibration as shown in FIG. 8. When the bending vibrations grow in intensity and the horizontal component of the vertically directed force transmitted through the cranks 18 become higher than the frictional force of the wheels 24, the two wheels 24 at the front and rear of the saddle 16 move back and forth in opposite directions, so that vertical displacements z are converted to horizontal displacements y. As a result, the sliding friction between the wheels 24 and rails 8A can achieve a damping effect, thereby greatly reducing the bending vibrations of the girder 1.

In the first embodiment as well as the embodiments subsequently to be described, the resilient means is not limited to the compression springs 26 and resilient rubber members may be used instead. The brake force of the brake 86 of the drive control means is preferably applied to the wheels 24 to control rotation of the latter so that the sliding friction between the wheels 24 and rails 8A may be increased. When the crane is subjected to vertical vibrations during its movement, the speed or direction of rotation of the wheels 24 caused by the motor 80 will not agree with the speed or direction of the horizontal displacement y of the wheels 24, and the difference in the speed or direction of rotation will cause a slip to occur. That is, sliding friction will occur between the wheels 24 and rails 8A. Thus, even if the brake force of the brake 86 is not utilized, the vertical bending vibrations of the girder 1 can be markedly reduced by the damping action performed by the sliding friction between the wheels 24 and rails 8A. This is also the case with the embodiments subsequently to be described. Also, in the first embodiment, the resilient means is directly secured to the girder 1 so as to resiliently support the girder 1 directly. However, resilient means may be mounted between two cranks 18 forming a pair as shown in FIG. 5, so as to give indirect resilient support to the girder 1.

Figure 12:
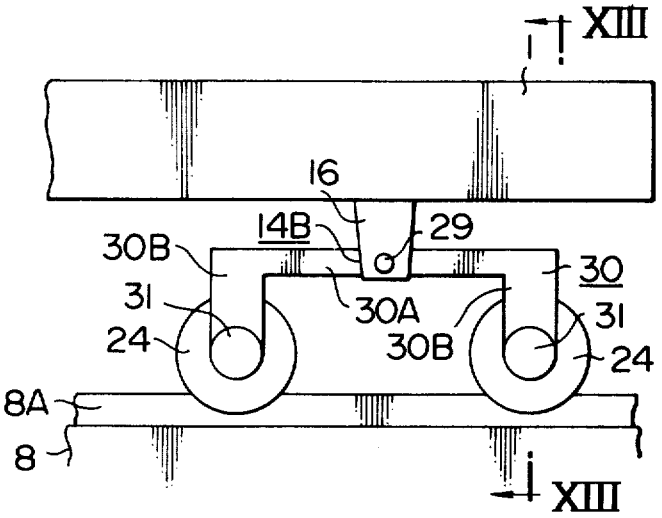
FIG. 12 is a front view of the travelling device of the overhead crane comprising a second embodiment of the invention.
Figure 13:
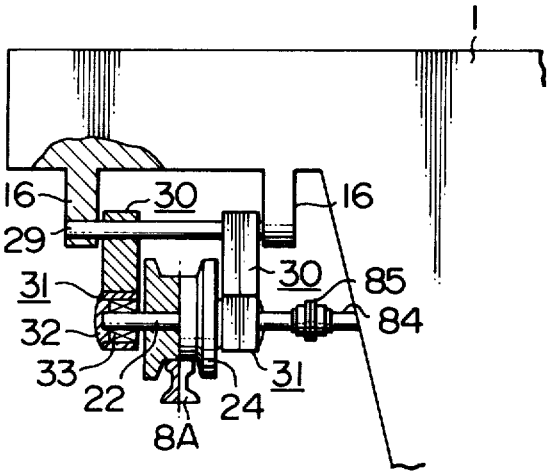
FIG. 13 is a fragmentary front view, with certain parts being shown in section, taken along the line XIII—XIII in FIG. 12 of the travelling device of the second embodiment.
Figure 14:
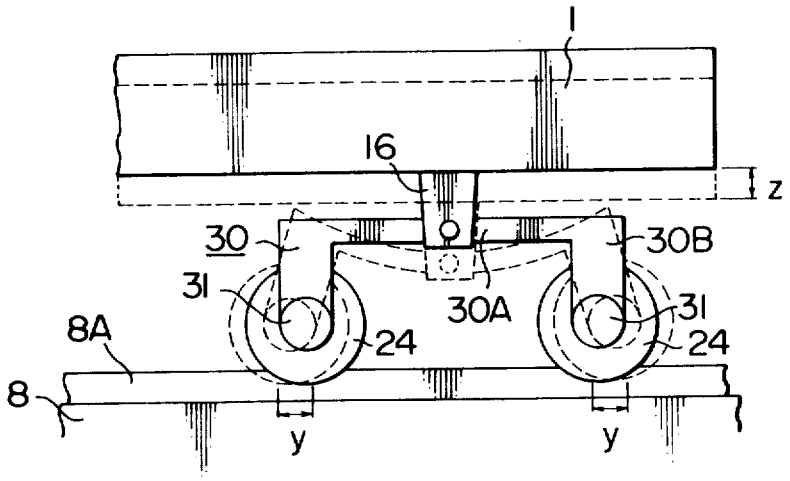
FIG. 14 is a view in explanation of operation of the travelling device of the second embodiment.

FIGS. 12–14 show a second embodiment which, like the first embodiment shown in FIGS. 5–9, is provided with the drive control means shown in FIGS. 10 and 11. As shown, a pair of saddles 16 is formed on the undersurface of each of opposite ends of each girder 1 to depend therefrom in spaced parallel relation. A pair of portal trunks 30 each including a horizontal bar 30A and two vertical legs 30B depending from opposite ends thereof is pivotally supported by a truck pin 29 extending through the center of each of the horizontal bars 30A and secured to the saddles 16 at opposite ends thereof. Each vertical leg 30B of the portal truck 30 has connected to its lower end a bearing box 31 including a cover 32 and a bearing 33. The axle 22 supporting the wheels 24 moving on the rails 8A is fitted between the juxtaposed gear boxes 31.

In the second embodiment of the aforesaid construction, when the shed 8 vibrates vertically and its vibrations are transmitted to the girder 1, through the rails 8A, wheels 24, resilient trucks 30 and saddles 16, the girder 1 develops vertical bending vibrations, which vibrations are increased and the horizontal component of a force exerted by the bending of the horizontal bars 30A in a manner to flex the resilient portal trucks 30 becomes higher than the frictional force exerted by the wheels 24; therefore the two wheels 24 at the front and rear of the saddle 16 move back and forth in opposite directions, so that the vertical displacements z are converted to horizontal displacements v. As a result, the sliding friction between the wheels 24 and rails 8A advantageously effects damping of vibrations to markedly damp the bending vibrations of the girder 1. In the second embodiment also, the brake force exerted by the brake 86 of the drive control means is preferably applied to the wheels 24 to inhibit rotation thereof, so as to thereby increase the sliding friction between the wheels 24 and rails 8A. The second embodiment offers the advantage that its travelling device 14B is simpler in construction than the travelling device 14A of the first embodiment.

Figure 15:
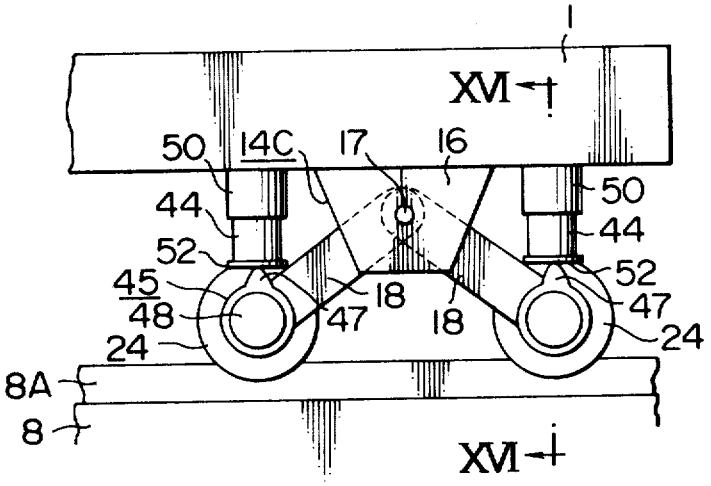
FIG. 15 is a front view of the travelling device of the overhead crane comprising a third embodiment of the invention.
Figure 16:
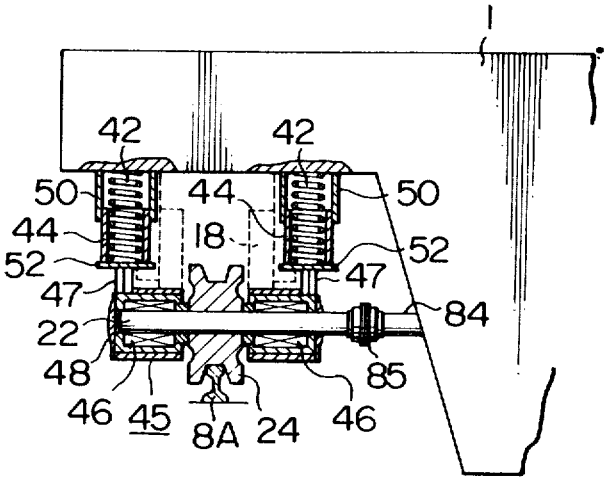
FIG. 16 is a sectional view of the travelling device of the third embodiment taken along the line XVI—XVI in FIG. 15.
Figure 17:
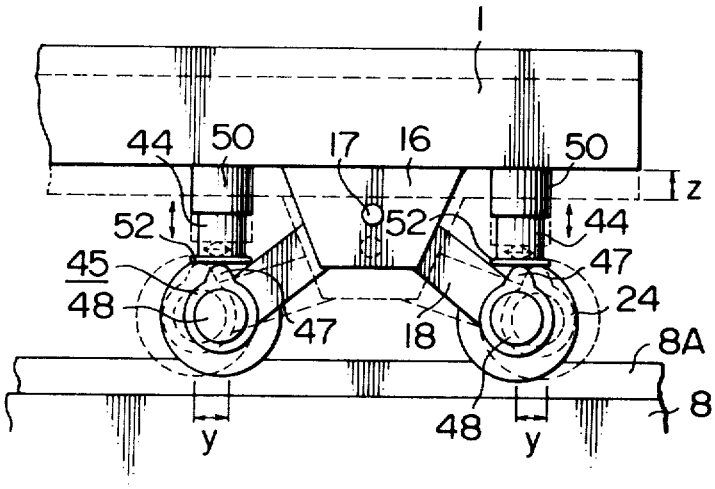
FIG. 17 is a view in explanation of the principle of operation of the travelling device of the third embodiment.

A third embodiment is shown in FIGS. 15–17 which is also provided with the drive control means described by referring to FIGS. 10 and 11. As shown, a pair of saddles 16 disposed parallel to each other is secured to the undersurface of either of opposite ends of the girder 1 of the crane and depends therefrom. Extending through the saddles 16 through a bush is a crank pin 17 which pivotally supports a pair of cranks 18 at either end thereof in such a manner that the cranks 18 of each pair are directly downwardly and inclined in opposite directions or forwardly and rearwardly with respect to the length of the saddle 16. Each crank 18 supports at its lower end a bearing box 45 including a bearing 46 and a cover 48 as shown in FIG. 16. An axle 22 for supporting the wheels 24 for rolling movement on the rails 8A extends between the two bearing boxes 45 across the rails 8A, and a compression spring 42 serving as resilient means is mounted between each bearing box 45 and girder 1. Each compression spring 42 is disposed in a fixed cylinder 50 secured to the undersurface of the girder 1 and a movable cylinder 44 having a slide plate 52 at its bottom and telescopically received in the fixed cylinder 50, so that the slide plate 52 is in pressing contact at its undersurface with a projection 47 formed on the surface of each bearing box 45. The compression spring 45 is not displaced horizontally.

The travelling device 14 of the aforesaid construction operates as shown in FIG. 17 when the shed 8 vibrates vertically, vertical vibrations of the shed 8 are transmitted through the rails 8A, wheels 24, compression spring 42, cranks 8, and saddles 16 to the girder 1 so that the girder 1 moves in vertical bending movement. As the vertical bending vibrations increase in intensity, the horizontal component of a vertically directed force transmitted through the cranks 18 becomes higher than the frictional force of the wheels 24. When this happens, the two wheels 24 are pushed to move in opposite directions as indicated by dotted lines and at the same time the projections 47 of the bearing boxes 45 slide relative to the slide plates 52, so that the vertical vibratory displacements z are converted to horizontal displacements y. Combined with the frictional force acting between the wheels 24 and rails 8A, the sliding friction between the slide plates 52 and the projections 47 of the bearing boxes 45 advantageously effects damping of the vibrations so that the bending vibrations of the girder 1 are markedly reduced.

In the third embodiment also, rotation of the wheels 24 can be inhibited by the brake force exerted by the brake 86 of the drive control means so as to thereby increase the sliding friction between the wheels 24 and rails 8A.

Figure 18:
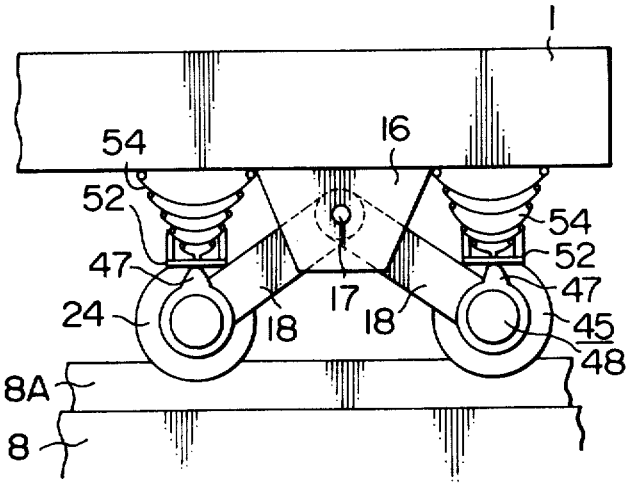
FIG. 18 is a front view of the travelling device of the overhead crane comprising a fourth embodiment of the invention.

FIG. 18 shows a fourth embodiment which is substantially similar to the third embodiment except that the resilient means of the fourth embodiment differs from that of the third embodiment and the members for housing the resilient means of the third embodiment are eliminated. More specifically, a plurality of plate springs 54, arranged in superposed relation one over another as shown in FIG. 18, are mounted between the girder 1 and each slide plate 52 so as to force the slide plate 52 against the projection 47 of the respective gear box 45 by the biasing force of the plate spring 54. The fourth embodiment of the aforesaid construction offers the advantage that in addition to the sliding friction described with reference to the third embodiment, the sliding friction between the plate springs 54 arranged one over another has a vibration damping function, so that the bending stress of the girder 1 can be reduced with increased effect.

Figure 19:
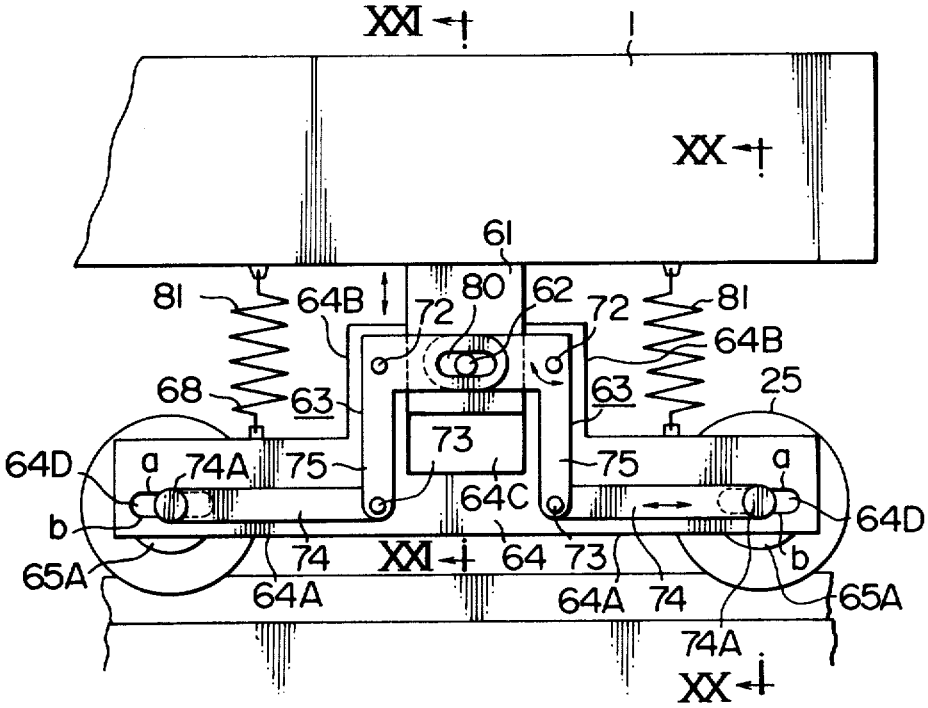
FIG. 19 is a front view of the travelling device of the overhead crane comprising a fifth embodiment of the invention.
Figure 20:
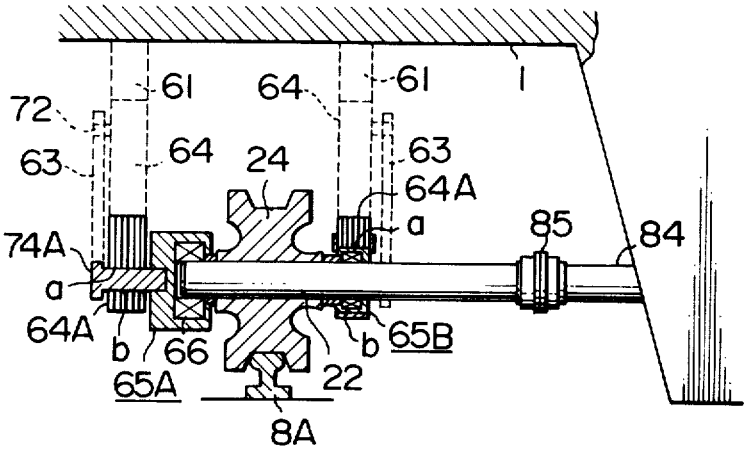
FIG. 20 is a sectional view of the travelling device of the fifth embodiment taken along the line XX—XX in FIG. 19.
Figure 21:
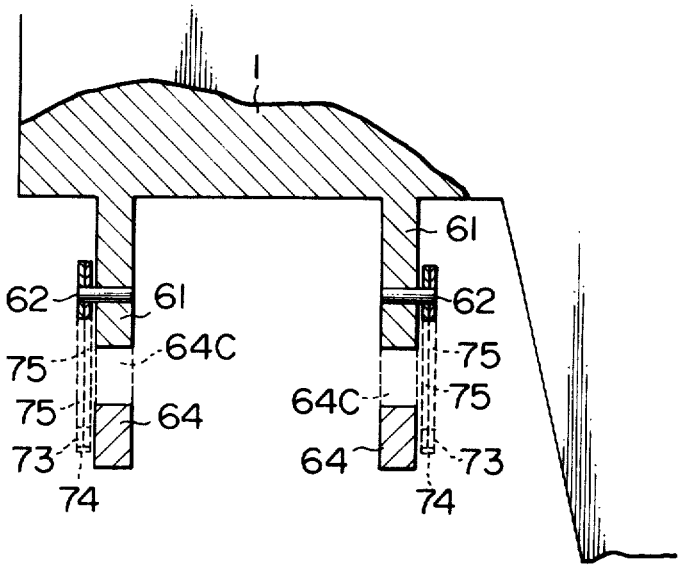
FIG. 21 is a sectional view of the travelling device of the fifth embodiment taken along the line XXI—XXI in FIG. 19.

A fifth embodiment of the invention is shown in FIGS. 19–21. The illustrated embodiment includes the drive control means described by referring to FIGS. 10 and 11. In the fifth embodiment, the girder 1 of the travelling overhead crane has on the undersurface of each of opposite ends thereof a pair of saddles 61 of the rectangular shape secured thereto and located in spaced juxtaposed relation lengthwise of the girder 1. A truck 64 includes two vertical portions 64B and a fitting portion 64C interposed between the vertical portions 64B and fitted between the pair of saddles 61 for vertical movement. The truck 64 also includes two horizontal arms 64A extending in opposite directions across the length of the girder 1 each formed near the forward end thereof with a horizontally directed slot 64D. As shown in FIG. 20, a pin 74A is inserted in each slot 64D of the horizontal arms 64A nearer to the end of the girder 1 and secured at its right end to each gear box 65A. A bearing box 65B is slidably attached to each slot 64D formed in the horizontal arms 64A remote from the end of the girder 1. The bearing boxes 65A and 65B each contain therein a bearing 66 journalling the axle 22 for the wheels 24.

The pin 74A is connected to the forward end of each of horizontal arms 74 of a crank 63 located nearer to the end of the girder 1. The crank 63 is composed of the horizontal arms 74, and an arm 75 of a substantially inverted U-shape having vertical portions each pivotally connected at the upper end to one of the two vertical portions 64B of the truck 64 by a pin 72, and a horizontal portion formed with a slot 80 for receiving therein for sliding movement a pin 62 secured to the saddle 61. The vertical portions of the arm 75 of the substantially inverted U-shape are each connected at the lower end for pivotal movement to each of the horizontal arms 74 through a pin 73. A compression spring 81 functioning as resilient means is mounted between the girder 1 and each horizontal arm 64A of the truck 64. The truck 64 fitted to the saddle 61 remote from the end of the girder 1 in FIG. 20 also has a crank 63 connected thereto and including horizontal arms 74 each fitted over one of the axles 22 for rotation.

In the fifth embodiment constructed as aforesaid, as the vertical bending vibrations increases in intensity and the horizontal component of the vertical vibrations transmitted through the cranks 63 becomes greater than the frictional force between the wheels 24 and rails 8A and the frictional force between surfaces a and b of the slots 64D of the truck 64 and pins 74A, the wheels 24 at the front and rear of the saddle 61 move back and forth horizontally in opposite directions and sliding friction is produced between the wheels 24 and rails 8A, so that the vertical bending vibrations of the girder 1 can be damped as they are converted to sliding friction.

The horizontal back-and-forth movement of the wheels 24 occurs as follows. When the crane vibrates vertically, vertically directed sliding movement occurs between each saddle 61 and the vertical portions 64B of the associated truck 64. This vertically directed sliding movement causes the pin 62 to move vertically, so that the arm 75 of the substantially inverted U-shape moves about the pins 72 as pivots. This movement of the arm 75 of the substantially inverted U-shape causes the horizontal arms 74 to move leftwardly and rightwardly in FIG. 19, so that the wheels 24 connected to the horizontal arms 74 through the axles 22 and gear boxes 65A also move leftwardly and rightwardly. That is, the wheels 24 move back and forth with respect to the length of the truck 64 in horizontal displacing movement.

In the fifth embodiment, the amount of vertical displacement of the girder 1 with respect to the shed 8 is transmitted to the wheels 24 as an increased amount of horizontal displacement by the leverage of the pin 72 when the vertical portions of the arm 75 of the substantially inverted U-shape have a length greater than the horizontal portion thereof. This increase the amount of sliding movement between the pin 74A and gear box 65B and the surfaces a and b of the slot 64D. Thus the damping effects achieved by the sliding friction is increased and the vertical bending vibrations of the girder is greatly reduced.

In the fifth embodiment, the saddle 61 and the associated truck 64 may be either in contact with or spaced apart from each other. When they are in contact with each other, additional frictional damping may be achieved by these parts. In the embodiment shown and described herein-above, the pin 74A moves in sliding movement in the associated slot 64D. However, the invention is not limited to this arrangement and that the slot 64D may be formed in the crank 63 and the associated pin 74A may be secured to the truck 64.

From the foregoing description, it will be appreciated that the travelling overhead crane incorporating therein the present invention is provided with a travelling device comprising resilient means for resiliently supporting each girder of the crane, and vibration direction converting means for converting the vertical vibrations of the crane to the horizontal vibrations of the wheels. Thus, in the event of an earthquake, vertical tremors of the earth are damped by the sliding friction acting between the wheels and the rails, so that the response of the girder to the vertical bending vibrations can be greatly reduced. It will be appreciated that the travelling overhead crane according to the invention is higher in earthquake-risistant characteristics, lighter in weight and economically more advantageous than cranes of the prior art wherein the natural frequency of the cranes is increased by increasing the rigidity of the girders to cope with vertical earth tremors in the event of an earthquake.

What is claimed is:

1. A crane comprising:

girders;

rail means for supporting the girders;

a travelling device for moving said girders along the rail means including a plurality of wheels for supporting the girders on the rail means;

means for mounting each of said wheels on the girders so as to enable the wheels to be horizontally displaceable with respect to the girders, said mounting means including vibration direction converting means for resiliently supporting said girders and for converting vertical vibrations to a horizontal displacement of the wheels, said vibration directing converting means comprises a pair of portal trucks, each of said portal trucks including a horizontal portion capable of undergoing resilient deformation in a vertical direction and being pivotally connected at a central portion of said horizontal portion to one of a pair of saddles secured to an undersurface of each of said girders, each portal truck including a pair of vertical portions each having mounted at a lower end thereof a bearing box containing a bearing supporting an axle for said wheels, and drive control means for driving said travelling device for movement and for interrupting the movement thereof.

2. A crane comprising;

girders;

rail means for supporting the girders;

a travelling device for moving said girders along the rail means including a plurality of wheels for supporting the girders on the rail means;

means for mounting each of said wheels on the girders so as enable the wheels to be horizontally displaceable with respect to the girders including vibration direction converting means for resiliently supporting said girders and for converting vertical vibrations to a horizontal displacement of the wheels, said vibration direction converting means comprises a plurality of pairs of cranks, cranks of each pair being pivotally connected at one end thereof to one pair of saddles secured to an undersurface of either end portion of each of said girders, each crank of each pair supporting at the other end thereof a bearing box containing therein a bearing supporting an axle for said wheels, spring means secured at an upper end to each of said girders and at a lower end to a side plate, and means for preventing said spring means from being displaced in a horizontal direction, said slide plate being forced against said bearing box; and drive control means for driving said travelling device for movement and for interrupting the movement thereof.

3. An earthquake resistant crane comprising;

girders;

rail means for supporting the girders;

a travelling device for moving said girders along the rail means including a plurality of wheels for supporting the girders on the rail means;

means for mounting each of said wheels on the girders so as to enable the wheels to be horizontally displaceable with respect to the girders including vibration direction converting means for resiliently supporting said girders and for converting vertical vibrations to a horizontal displacement of the wheels, said vibration direction converting means comprises a pair of trucks, each truck being fitted at a fitting portion for vertical movement to one of a pair of saddles secured to an undersurface of either end portion of one of said girders and supporting at a forward end of each of a pair of horizontal arms a bearing for said wheels for movement in the horizontal direction, a pair of cranks, each crank including a substantially U-shaped arm and a pair of horizontal crank arms, said U-shaped arm including a central portion and two vertically extending portions, the U-shaped arm is pivotally supported at the central portion thereof by one of said saddles and pivotally supported at upper ends of the vertical portions thereof to an associated one of said trucks, a forward end of each of said horizontal crank arms is connected to a bearing box for said bearing so as to convert vertical vibrations to horizontal displacement of the wheels, and spring means mounted between each of said trucks and each of said girders for supporting said girders in a vertical direction; and drive control means for driving said traveling device for movement and for interrupting the movement thereof.

4. A crane as claimed in one of claims 1, 2 or 3, wherein the drive control means includes a plurality of motive force transmitting shaft means, each of the shaft means is connected to one of the wheels through a flexible gear coupling means at a first end thereof and to a drive means at a second end thereof.

5. A crane as claimed in one of claims 2 or 3, wherein each of said resilient means is disposed vertically.

* * * * *